United States Patent [19]

Duddridge

[11] 4,181,053

[45] Jan. 1, 1980

[54] FOOD SLICERS

[75] Inventor: John M. Duddridge, Barnham, England

[73] Assignee: Danepak Ltd., Norfolk, England

[21] Appl. No.: 827,633

[22] Filed: Aug. 25, 1977

Related U.S. Application Data

[63] Continuation of Ser. No. 700,987, Jun. 29, 1976, abandoned.

[51] Int. Cl.[2] ..... B26D 4/46

[52] U.S. Cl. ..... 83/80; 83/88; 83/110; 198/423

[58] Field of Search ..... 83/80, 81, 88, 110, 83/77; 198/155, 423, 424

[56] References Cited

U.S. PATENT DOCUMENTS

| | | | |
|---|---|---|---|
| 2,426,835 | 9/1947 | Mahler | 83/88 |
| 2,898,962 | 8/1959 | Burnett | 83/88 |
| 3,015,350 | 1/1962 | Reichel et al. | 83/88 |
| 3,105,533 | 10/1963 | Hensgen et al. | 83/77 |

*Primary Examiner*—J. M. Meister

*Attorney, Agent, or Firm*—William Anthony Drucker

[57] ABSTRACT

Apparatus for use with a food slicer comprising a conveyor for location adjacent to the said slicer and adapted to receive slices of food as they are cut by the slicer; a pump for generating hydraulic pressure, a motor driven by said hydraulic pressure; passageways between said pump and said motor; means for drivingly connecting said motor to said conveyor; a flow limiting valve in the passageway between the pump and the motor for limiting the speed at which the said motor drives said conveyor; and means for periodically increasing the fluid flow to the motor temporarily to accelerate said motor.

2 Claims, 3 Drawing Figures

FOOD SLICERS

This is a continuation of Ser. No. 700,987, filed June 29, 1976, now abandoned.

This invention is for improvements in or relating to food slicers and is particular concerned with providing improvements in apparatus for the slicing of bacon.

Sides of bacon are conveniently sliced into rashers by a rotating knife, and one known form of slicer which has a spiral cutting edge cuts through the side of bacon as the knife rotates. A known slicer of this kind is "Anco" slicer and the present invention is particularly but by no means exclusively concerned with provided improvements in or relating to apparatus for use with an "Anco" bacon slicer.

The invention however does however have application to the slicing of other foodstuffs including meat products such as meat loaves, fish products, bread and similar.

It will be appreciated that many food products are pre-packed. That is to say the food product is packed in factory conditions and normally it is packed in a vacuum sealed envelope, so that it may be stored in refrigerated conditions and the purchaser will know that they are obtaining a factory fresh product of a predetermined weight which will have a stamped shelf-life on the package. It is therefore important for the packing of foodstuffs which require slicing or cutting that means are provided to ensure that the minimum pre-determined weight for the foodstuff are designated on the package is in fact inserted in the package under the factory conditions.

In the case of the slicing of bacon it will be appreciated that a side of bacon is sliced into rashers and it is convenient to associate with the slicing machine a conveyor for taking away the slices of bacon known as the bacon shingle. It is also desirable to have means which enable the shingle to be separated into convenient number of rashers forming approximately the units of the predetermined weight of the bacon to be inserted into the package.

It is known to provide for a conveyor belt beneath the cutting knife of a bacon slicer so that as the rashers fall onto the belt they are moved away in the form of a shingle. The rate of movement of the conveyor may be regulated relative to the rate at which the rashers are cut from the bacon so that the distance between successive edges of the rashers can be varied.

It will be further appreciated that having formed a shingle it is necessary to portion the shingle into the convenient sized packs and since it is a requirement that bacon shall be sold by weight in most countries it is necessary to weigh the portions to be packed.

Conveniently it is known to pack the rashers in packets of five, six or seven rashers. It is therefore necessary for an operative to remove the desired number of rashers from the shingle weigh them and then pack them. If all the rashers which form the shingle are laid closely adjacent to each other it becomes a time consuming operation, to separate and hence portion the necessary number of rashers from the shingle as there is a tendency for one rasher to adhere to the next.

It is therefore an object of the present invention to provide for conveying means in conjunction with a food slicing machine particularly an "Anco" bacon slicing machine whereby the food stuff as cut by the slicing machine is portioned into predetermined units ready for packing at the time that the slices are cut from the foodstuff.

Particularly is the present invention concerned with providing conveying means for use with a bacon slicing machine whereby the shingle cut by the slicing machine is portioned into predetermined units ready for packing into the required units of weight for the rashers as they are cut from the side of bacon.

Accordingly the present invention provides apparatus for use with a food slicer comprising a conveyor for location adjacent to the said slicer and adapted to receive slices of food as the said slices are cut by the slicing machines, a pump for generating hydraulic pressure, motor driven by hydraulic pressure, passageways between said pump and said motor, means for driving connecting said motor to said pump, a flow limiting valve in the passageway between the pump and the motor for limiting the speed at which the said motor drives said conveyor and means for periodically increasing the rate of fluid flow to the motor temporarily to accelerate the motor.

According to one construction of the present invention the flow limiting valve is in the nature of a flow control valve a bypass for the flow control valve is provided so that on opening the bypass an increase in flow of hydraulic fluid to the motor is provided which will temporarily and for a short period of time accelerate the motor driving the conveyor. It will be appreciated that by accelerating the speed of the conveyor for a relatively short period of time that the slices of food cut by the slicing machine which are falling onto the conveyor will be spearated into portions. That is to say the distance between adjacent edges of the slices will be increased while the conveyor is moving at the higher speed. As applied to the slicing of bacon if the conveyor moves at a uniform speed, then the shingle will all be uniformly spaced, but by temporarily accelerating the conveyor the shingle may be portioned into desired numbers of rashers 5, 6 or 7 or any other convenient number as desired.

In an alternative construction the flow limiting valve is a servo-valve. A servo-valve may be defined as a valve having an inlet port and an outlet port and means between the said ports which may be adjusted to vary the rate of fluid flow therethrough. The means for adjusting the rate of fluid flow therethrough may be electrically or pneumatically operated. The servo-valve of the kind suitable for use in the present invention will have adjustment means for presetting the rate of fluid flow through the valve and have further adjustment means which on actuation vary that rate of fluid flow to an alternative and greater rate of fluid flow.

According to the present invention therefore the servo-valve will be in the passageway between the pump providing the hydraulic pressure and the motor for driving the conveyor and the servo-valve will be preset to provide a given rate of linear movement of the conveyor. On suitable actuation the servo-valve will open to allow a greater rate of fluid flow therethrough thereby temporarily accelerating the flow of hydraulic fluid to the motor and thereby temporarily accelerating the conveyor.

As applied to the packing of bacon the present invention also provides for means for counting the number of rashers of bacon which are cut and for means for actuating the flow limiting valve according to a pre-arranged sequence so that during the cutting or slicing of a first part of a bacon side the conveyor is accelerated say after every fifth rasher has been cut. Then during the cutting of the middle part of the bacon side the conveyor is acclerated after every sixth rasher has been cut and finally during the cutting of the last part of the bacon side the conveyor is accelerated after every seventh rasher has been cut. By this arrangement the number of rashers forming portions on the conveyor being of substantially the same weight, notwithstanding their being cut from different parts of the bacon side.

For example if it is desired to portion the shingle of bacon into approximately half pound packs then five rashers cut from the shoulder end of a bacon back may constitute approximately half a pound where seven said rashers from the opposite gammon end of said back may be required to form a half pound pack.

Thus means are provided for counting five cut rashers for say the first half dozen units of the shingle which are portioned and then the next half dozen are counted in sixes and the final half dozen in sevens or any other desired number, as the case may be.

The present invention provides for counting means which are operated by the rotation of the cutting blade such that after a predetermined number of rotations an electric impulse is sent from said counting means to a valve in the hydraulic circuit such that the flow limiting valve is bypassed or in the case of a servo-valve is actuated to allow an increase of hydraulic fluid flow to the motor driving the conveyor to accelerate it and cause a jerk or jump to the conveyor, thus to displace the previously cut rasher of the shingle, a greater distance along the length of the conveyor so form a gap or mark between the last cut rasher of one shingle and the first cut rasher of the suceeding shingle.

In order that the present invention may be more readily understood reference is now made to the accompanying drawings in which.

Figure 2:
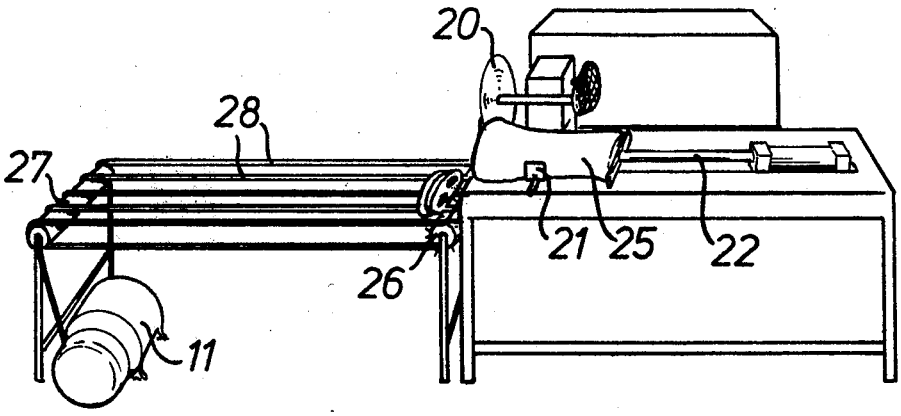
FIG. 2 is a side schematic view of apparatus according to the present invention.
Figure 3:
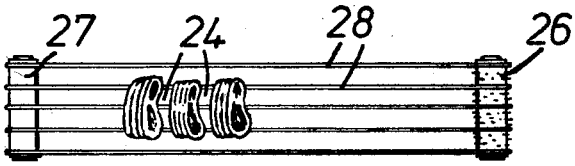
FIG. 3 is a plan view of a conveyor according to the present invention.

In FIGS. 2 and 3 a slicing machine has a rotating blade 20. The present invention is particularly suitable but by no means exclusively concerned with bacon slicing machines of the kind known as "Anco" slicers. A piece of bacon 25 is placed onto a flat surface of the machine so a ram 22 may advance the bacon 25 between guides 21 towards the rotating cutter blade 20. As the blade rotates it slices the bacon into rashers of predetermined thickness. The rashers after being cut from the piece of bacon form a shingle onto a spiked roller 26 forming the end roller of a ribbon conveyor 28. The spiked roller 26 is freely rotatable in end bearings. Desirably the end roller 27 of the conveyor is driven by a hydraulic motor 11. As the rashers fall onto the spiked roller it is rotated by the ribbons of conveyor 28 and thus the rashers forms a shingle along the length of the conveyor.

Figure 1:
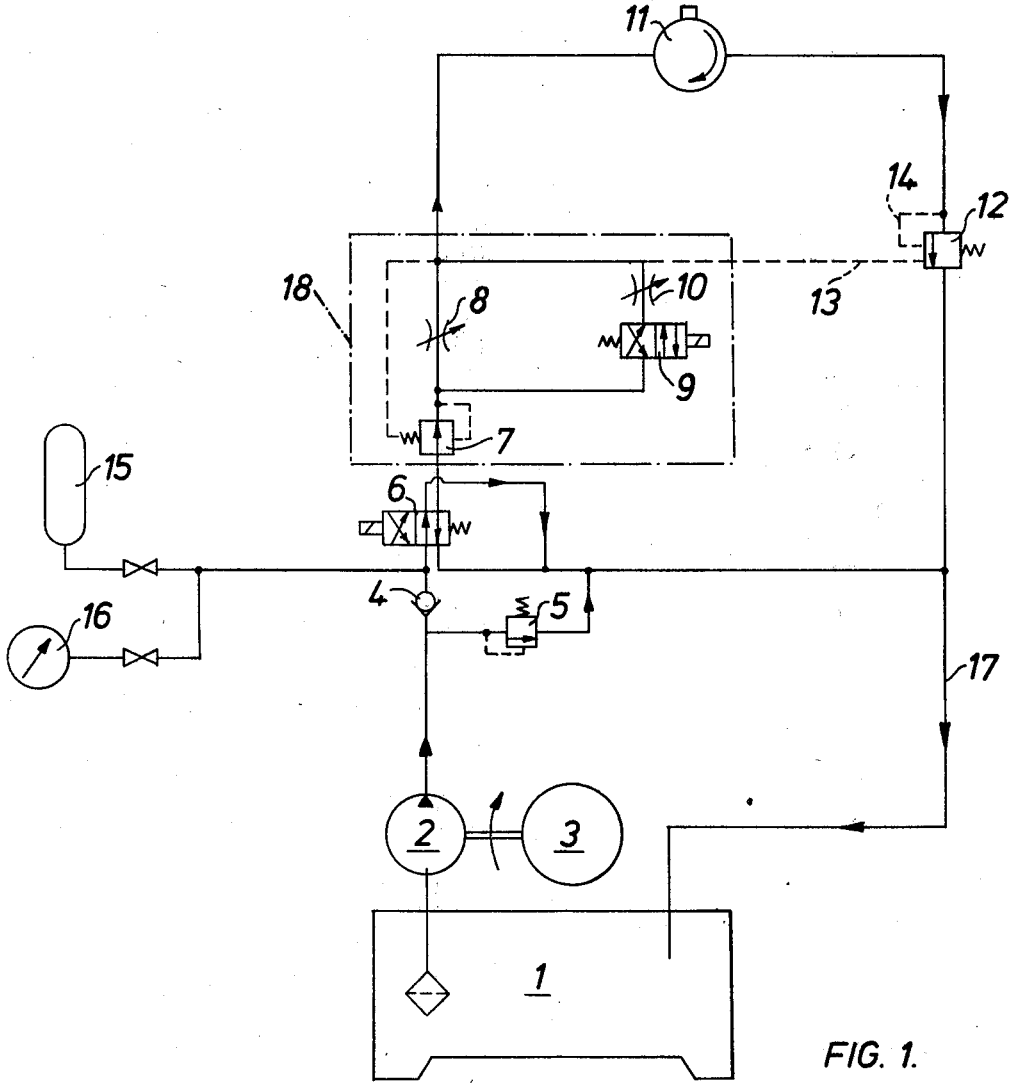
FIG. 1 is a hydraulic circuit diagram.

The hydraulic circuit for actuation of component parts of the slicing machine illustrated in FIGS. 2 and 3 is illustrated in FIG. 1, and consist of a reservoir 1 for hydraulic fluid, a hydraulic pump 2 for withdrawing fluid from the reservoir 1 which pump 2 is driven by an electric motor 3. Fluid from the outlet of pump 2 is passed through a nonreturn valve 4 to a fluid recirculating valve 6 for safety purposes hereinafter described. A pressure relief valve 5 is inserted in the circuit between the pump and the non return valve 4. The safety valve 6 is connected to a pressure maintaining sensor 7 which leads to a flow control valve 8 and from the flow control valve 8 the hydraulic fluid is fed to a hydraulic motor 11. From the hydraulic motor 11 the fluid passes through a further pressure maintaining sensor 12 and from thence via line 17 to the reservoir tank 1. The pressure relief valve 5 also is connected to the return line 17 so that should for any reason the pressure in the circuit exceed a preset value of the pressure limiting valve 5 then the excess fluid is recirculated via the pump 2 and line 17 to the reservoir tank 1.

Similarly the safety valve 6 is provided so that in the normal condition the fluid from the non return valve 4 is fed to the pressure maintaining valve 7 and this will normally be driving the motor 11, but should anything come amiss then all the operative for the machine has to do is immediately to press the safety valve 6 and the change over of the connections as illustrated in the Figure will take place recycling the fluid pressure from the pump 1 to the line 17 and thus immediately disconnecting the flow of hydraulic fluid to the motor 11.

Connected immediately adjacent to the non return valve 4 is a circuit comprising a pressure gauge 16 and a nitrogen reservoir tank 15. The purpose of the tank is to act as a pressure/volume maintaining reservoir. It will be appreciated that the gas in the container 15 is already under pressure and as the hydraulic fluid passes through the non return valve the fluid will pass into the tank 15 and will be maintained at a uniform pressure. If a sudden call for hydraulic fluid occurs then there would under normal circumstances be insufficient volume or pressure of fluid in the hydraulic lines to supply it direct from the pump but by maintaining the tank 15 with a surplus of fluid in circuit under pressure then any demand for increase of fluid can be met by withdrawing the fluid from the pressure tank 15, replacing the volume of oil at pressure during the uniform or shingle speed portion of the cutting cycle.

In the circuit as illustrated in FIG. 1 a bye-pass line is provided around the flow control valve 8 which consists of the change over valve 9 and a further flow constricting valve 10. Under normal circumstances the flow of hydraulic fluid is through the flow control valve 8 to the hydraulic motor 11. The desired rate of advancement of the conveyor driven by the hydraulic motor 11 is controlled by the flow limiting valve 8.

It will be appreciated that if the flow constricting valve 10 allows more fluid to pass therethrough than the flow control valve 8 then on operation of the change over valve 9 byepass of the flow control valve 8 is provided which will allow an increase supply of hydraulic fluid under pressure to be fed to the motor 11 and thus temporarily accelerating the motor 11 and causing a jerk or jump of the conveyor 28 forming a discreet gap and portioning the shingle of bacon being cut by the bacon slicing machine.

The extent of the increase of speed may be adjusted by adjustment of the flow limiting valve 10. The pressure sensitive devices 7 and 12 are provided to maintain an adequate drop of pressure of hydraulic fluid across the motor 11. The pressure sensitive device 7 has a feed back at each side of the flow limiting valve 8 so as to maintain a sufficient pressure of fluid at each side of the flow limiting valve 8. The pressure sensitive device 12 similarly ensures that there is an adequate drop of pressure on the outlet of the motor 11 and a feed back from the outlet of the flow limiting valve 8 to said sensitive device 12 is provided to ensure that there is an adequate pressure drop across the motor 11. If there is no sufficient pressure drop between the inlet and the outlet of the motor 11 then the motor 11 will not be driven either at sufficient speed or with sufficient torque.

The operation of the change over valve 9 may be effected by a solenoid valve or by any other convenient means. The said means for controlling the change over valve 9 may be from an electronic programme controller which may be manually started through an appropriate start switch. Under normal conditions the fluid provided by pump 2 drives the motor 11 and may also be used to provide hydraulic control for the ram 22. A magnetic reed switch may be connected to the rotating shaft of blade 20 so that the number of rashers cut from the bacon side 21 are counted and the programme controller consisting of electronic apparatus counts the number of impulses from said reed switch and after a predetermined number of impulses has been received provides an output impulse to the means for controlling the change over valve 9. The programme controller may be arranged for an overriding controller programme so that a predetermined number of impulses have to be counted before an output pulse is sent to the control means for the change over valve 9, and the programme may be arranged to vary the number of impulses counted by the programmer as the cutting proceeds.

By the present invention it will be appreciated that means for temporarily accelerating a conveyor for food slicing machines is provided. In an alternative arrangement the flow limiting valve 8 the changeover valve 9 and the flow constricting valve 10 enclosed with the line 18 may be replaced by a servo valve not specifically illustrated which servo valve will have means for presetting the rate of fluid flow therethrough under normal conditions and which will have means which may be either hydraulically or desirably electrically operated for temporarily changing that rate of fluid flow therethrough to increase the rate of fluid flow thereby to accelerate the motor 11.

What is claimed is:

1. Apparatus comprising, in combination, a conveyor for receiving slices of a food stuff as they are cut by a slicer, a pump for generating hydraulic pressure, a motor driven by said hydraulic pressure, means defining a fluid flow path between said pump and said motor, means for drivingly connecting said motor to said conveyor, a preset flow control valve in the flow path between the pump and the motor for limiting the speed at which the said motor drives said conveyor, and means for temporarily by-passing said control valve thereby to increase the fluid flow to said motor to accelerate the motor.

2. Apparatus comprising, in combination, a conveyor for receiving slices of a foodstuff as they are cut by a slicer, a pump for generating a fluid pressure, a motor driven by said fluid pressure, means defining a fluid flow path between said pump and said motor, means for drivingly connecting said motor to said conveyor, a preset flow control valve in the flow path between the pump and the motor for limiting the speed at which said motor drives said conveyor, and means for temporarily by-passing said control valve thereby to increase the fluid flow to said motor to accelerate the motor.

* * * * *